US007874110B2

(12) United States Patent
Matthaei et al.

(10) Patent No.: US 7,874,110 B2
(45) Date of Patent: Jan. 25, 2011

(54) REINFORCED OR PRE-STRESSED CONCRETE PART WHICH IS SUBJECTED TO A TRANSVERSE FORCE

(76) Inventors: Oliver Matthaei, Neue Strasse 175, 70186 Stuttgart (DE); Hans-Peter Andrä, Im Betzengaiem 40, 70597 Stuttgart-Sonnenberg (DE)

( * ) Notice: Subject to any disclaimer, the term of this patent is extended or adjusted under 35 U.S.C. 154(b) by 769 days.

(21) Appl. No.: 10/182,208

(22) PCT Filed: Jan. 20, 2001

(86) PCT No.: PCT/EP01/00634

§ 371 (c)(1),
(2), (4) Date: Oct. 16, 2002

(87) PCT Pub. No.: WO01/53623

PCT Pub. Date: Jul. 26, 2001

(65) Prior Publication Data

US 2003/0154674 A1 Aug. 21, 2003

(30) Foreign Application Priority Data

Jan. 20, 2000 (DE) ..... 100 02 383

(51) Int. Cl.
*E04B 5/10* (2006.01)
*E04B 5/18* (2006.01)

(52) U.S. Cl. ..... 52/260; 52/52; 52/414; 52/236.9; 52/253

(58) Field of Classification Search ..... 52/236.7, 52/236.8, 250, 251, 649.1, 414, 260, 252, 52/249, 253, 257, 737.2, 737.1, 426, 236.9, 52/259

See application file for complete search history.

(56) References Cited

U.S. PATENT DOCUMENTS

| | | | | | |
|---|---|---|---|---|---|
| 667,871 | A | * | 2/1901 | Ellinger | 52/250 |
| 692,309 | A | * | 2/1902 | Knoche | 52/261 |
| 729,299 | A | * | 5/1903 | Ellinger et at | 52/252 |
| 742,943 | A | * | 11/1903 | Wight | 52/261 |
| 865,336 | A | * | 9/1907 | Gardner | 52/236.8 |

(Continued)

FOREIGN PATENT DOCUMENTS

DE 35 23 656 A1 2/1986

(Continued)

OTHER PUBLICATIONS

International Preliminary Examination Report, pertaining to PCT Serial No. PCT/EP 01/00634.

(Continued)

*Primary Examiner*—Phi Dieu Tran A
(74) *Attorney, Agent, or Firm*—Patterson & Sheridan, LLP

(57) ABSTRACT

The invention concerns a reinforced concrete or prestressed concrete part stressed by shearing forces with layers of reinforcement (22, 24) provided at its upper and lower sides. For shear protection at least one sheet metal reinforcing part (30, 32, 34, 36) is provided between these layers of reinforcement which mainly extends at right angles to a surface of the reinforced concrete part and mainly over the entire distance between the layers of reinforcement (22, 24) and crosswise to at least one crack (50) occurring in the reinforced or prestressed concrete part under transverse load.

25 Claims, 7 Drawing Sheets

U.S. PATENT DOCUMENTS

| | | | | | |
|---|---|---|---|---|---|
| 883,768 | A | * | 4/1908 | White | 52/693 |
| 947,769 | A | * | 1/1910 | Conzelman | 52/260 |
| 976,183 | A | * | 11/1910 | Jones | 52/732.1 |
| 980,480 | A | * | 1/1911 | Bishop | 52/745.17 |
| 1,009,712 | A | | 11/1911 | Anderson | |
| 1,050,477 | A | * | 1/1913 | Lindau | 52/251 |
| 1,053,646 | A | * | 2/1913 | Roberts | 52/262 |
| 1,056,463 | A | * | 3/1913 | Skinner | 52/344 |
| 1,060,853 | A | * | 5/1913 | Peirce | 52/283 |
| 1,088,956 | A | * | 3/1914 | Anderson | 52/260 |
| 1,262,449 | A | * | 4/1918 | Chew | 52/252 |
| 1,303,741 | A | * | 5/1919 | Thomas | 52/87 |
| 1,461,891 | A | * | 7/1923 | Coney | 52/253 |
| 1,625,899 | A | * | 4/1927 | Lally | 52/260 |
| 1,648,387 | A | * | 11/1927 | Palmer | 52/372 |
| 1,720,193 | A | * | 7/1929 | White | 52/649.1 |
| 1,955,498 | A | * | 4/1934 | Holby | 52/577 |
| 1,982,343 | A | * | 11/1934 | Kane | 52/252 |
| 2,033,595 | A | | 3/1936 | Strehan | 79/15 |
| 2,053,873 | A | * | 9/1936 | Niederhofer | 52/213 |
| 2,064,910 | A | * | 12/1936 | Harper | 52/335 |
| 2,108,065 | A | * | 2/1938 | Kotrbaty | 52/92.2 |
| 2,143,887 | A | * | 1/1939 | Kotrbaty | 52/262 |
| 2,241,169 | A | * | 5/1941 | Yokes | 52/223.7 |
| 2,697,930 | A | | 12/1954 | Cheskin | 72/15 |
| 2,836,529 | A | * | 5/1958 | Morris | 442/187 |
| 3,347,007 | A | * | 10/1967 | Hale | 52/380 |
| 3,562,979 | A | * | 2/1971 | Ali-Oglu | 52/125.5 |
| 3,594,971 | A | * | 7/1971 | Hughes | 52/648.1 |
| 3,645,056 | A | * | 2/1972 | Gerola | 52/259 |
| 3,721,058 | A | * | 3/1973 | Dewey et al. | 52/251 |
| 3,736,709 | A | * | 6/1973 | Koch et al. | 52/97 |
| 3,744,196 | A | * | 7/1973 | Weese | 52/70 |
| 3,990,193 | A | * | 11/1976 | Ray et al. | 52/79.11 |
| 3,990,200 | A | * | 11/1976 | Kawasaki et al. | 52/169.1 |
| 3,996,713 | A | * | 12/1976 | Haeussler | 52/309.12 |
| 4,050,213 | A | * | 9/1977 | Dillon | 52/742.14 |
| 4,078,345 | A | * | 3/1978 | Piazzalunga | 52/79.13 |
| 4,123,888 | A | * | 11/1978 | Kajava | 52/726.1 |
| 4,185,423 | A | * | 1/1980 | Gutierrez | 52/79.9 |
| 4,909,002 | A | * | 3/1990 | Clifton et al. | 52/100 |
| 4,998,393 | A | * | 3/1991 | Baena | 52/236.9 |
| 5,414,972 | A | * | 5/1995 | Ruiz et al. | 52/600 |
| 5,507,124 | A | * | 4/1996 | Tadros et al. | 52/251 |
| 5,809,712 | A | * | 9/1998 | Simanjuntak | 52/223.7 |
| 5,867,964 | A | * | 2/1999 | Perrin | 52/745.1 |
| 5,896,714 | A | * | 4/1999 | Cymbala et al. | 52/426 |
| 6,000,194 | A | * | 12/1999 | Nakamura | 52/783.17 |
| 6,003,281 | A | * | 12/1999 | Pilakoutas | 52/742.14 |
| 6,041,562 | A | * | 3/2000 | Martella et al. | 52/236.7 |
| 6,112,489 | A | * | 9/2000 | Zweig | 52/405.1 |
| 6,708,459 | B2 | * | 3/2004 | Bodnar | 52/356 |
| 6,820,384 | B1 | * | 11/2004 | Pfeiffer | 52/426 |
| 2001/0010140 | A1 | * | 8/2001 | Ritter et al. | 52/649.1 |

FOREIGN PATENT DOCUMENTS

| | | | | |
|---|---|---|---|---|
| DE | 195 43 768 A 1 | | 5/1997 | |
| DE | 197 12 283 C 1 | | 5/1998 | |
| DE | 197 41 509 A 1 | | 3/1999 | |
| EP | 0 414 484 A1 | | 2/1991 | |
| EP | 0 495 334 A1 | | 8/1991 | |
| FR | 332.797 | | 11/1903 | |
| JP | 128815 | * | 10/1979 | 52/251 |
| JP | 118141 | * | 5/1993 | 52/649.1 |

OTHER PUBLICATIONS

International Search Report, pertaining to PCT Serial No. PCT/EP 01/00634.

Neues, vortellhaftes Verbundmittel für Stahlverbund-Tragwerke mit hoher Dauerfestigkelt.

Riss AC; EMPA-BERICHTE, Nr. 65'138 und Nr. 121'921/1.

* cited by examiner

REINFORCED OR PRE-STRESSED CONCRETE PART WHICH IS SUBJECTED TO A TRANSVERSE FORCE

CROSS-REFERENCE TO RELATED APPLICATIONS

This application claims benefit of German patent application number DE20001002383 20000120, publication date Jul. 26, 2001, which is herein incorporated by reference.

BACKGROUND OF THE INVENTION

1. Field of the Invention

The invention concerns a slab reinforcement with a reinforced concrete column and a slab part made of reinforced concrete or prestressed concrete. The invention further concerns a procedure for the fabrication of such slab reinforcements.

2. Description of the Related Art

Reinforced concrete or prestressed concrete parts, e.g. of a supported slab require shearing check in the form of shear reinforcement in the area of the columns and in other areas.

Known types of shear reinforcement include: shear reinforcement made of reinforcing steel in the form of S-shaped hooks or stirrups, "stud rails", double-headed studs, stirrup mats, lattice beams, "Tobler" hip, "Geilinger" collar, "Riss" star.

Because of the poor anchorage, a shear reinforcement made of reinforcing steel in the form of S-shaped hooks or stirrups must embrace a mostly existing bending longitudinal reinforcement to prevent the shear reinforcement from tearing out. This is very expensive. In the case of high reinforcement ratios of the bending tensile reinforcement and a high shearing reinforcement ratio, conventional stirrups are regarded as unsuitable.

Stud rails are mostly placed onto the lower formwork, so that the lower layer of reinforcement is encompassed by its cross-section. Exact position and fixing of the rail is decisive for the load bearing performance. The stud rails are welded made-to-order pieces and therefore expensive.

Double-headed studs are usually threaded in from above between the upper and lower layers of the existing longitudinal bending reinforcement. In the case of high reinforcement ratios of the flexural tensile reinforcement and different mesh sizes of the upper and lower layers, this is very difficult and sometimes they cannot be installed. The double-headed studs are made to order and therefore expensive.

Stud rails and double-headed studs are very much used, but series production is not economical because of the high storage costs. Another problem is the danger of confusion and storage of different stud rails and double-headed studs on the construction site.

Tobler hip and collar are steel mounting parts consisting of steel sections welded together and made to order. The bearings structures are to be installed under steelworks conditions and are therefore expensive and labor-intensive. Due to their weight, the mounting parts need to be placed by means of cranes or other hoisting gear.

The functioning of all common solutions depends on concrete as a material. A look at the load paths (path of the shear forces) shows that the load is transferred in and out of the reinforcing elements several times until it reaches the non-critical area. Failure due to shear or compressive fracture, or tearing out of the reinforcing parts can occur.

Therefore, it is one of the objects of the invention, to provide a new slab/ceiling reinforcement and a method for its fabrication.

SUMMARY OF THE INVENTION

In accordance with a first characterizing feature of the invention, this objective is achieved by the subject matter of independent claim 1. Because of the sheet metal reinforcing part, shear forces and moments can be absorbed and distributed better. If first cracks occur when the concrete's ultimate tensile strength is reached, the load can be distributed over the reinforcing part in a fan-like way. Participation of the concrete for the ties is not necessary. The loads are carried off directly via the reinforcing part in accordance with the principle of minimum deformation work. As a consequence, cracks due to shear forces remain small and the ultimate strength of the concrete part is maximized. The reinforcing part thus assumes the concrete's function when the concrete reaches its ultimate tensile strength. The reinforcing part encompasses the continuous bending reinforcement of the reinforced concrete column. In this way the punching shear reinforcement provides structural protection against cracking of the flat slab. A flexural reinforcement in the compression zone running over the reinforced-concrete column, as described in DE-A1-19741509, is thus not necessary.

To the best advantage, the invention is further developed in accordance with the characterizing features of claim 2, because the ultimate load of a reinforced concrete part can be improved in a simple way. Reinforced concrete part here always also means prestressed concrete part.

In accordance with another characterizing feature of the invention, the objective is achieved by the subject matter of claim 7. The shape allows easy installation of the reinforcing part between the upper and lower layers of the flexural reinforcement. Additional position guards are not required. Once the lower layer of reinforcement is installed, the reinforcing part is placed onto it and can thus serve as an additional spacer for the upper layer.

According to one aspect of the invention, there is provided a slab reinforcement comprising a reinforced-concrete column; a slab portion of reinforced concrete or prestressed concrete with an upper layer of reinforcement and a lower layer of reinforcement which transfers loads into the reinforced-concrete column; reinforcing elements provided in the reinforced-concrete column which penetrate the slab part; at least one sheet metal reinforcing part; and anchoring means to anchor the concrete. The at least one sheet metal reinforcing part encompasses a reinforcing element of the reinforced-concrete column and, starting from this reinforcing element, between the upper layer of reinforcement and the lower layer of reinforcement of the slab part, basically extends over the complete distance between these layers of reinforcement, and is essentially perpendicular to a surface of the slab part.

The sheet metal reinforcing part in horizontal projection may have the shape of a U, V, hairpin or similar. The sheet metal reinforcing part may be corrugated, bent in the shape of a hat or bent in the shape of a trapezoid. The sheet metal reinforcing part may be made of steel, or alternatively a carbon fiber material or a plastic or a composite material.

According to another aspect of the invention, there is provided a method of manufacture of a ceiling reinforcement with a reinforced-concrete column with reinforcing elements and a ceiling portion of reinforced steel or prestressed steel. The method comprises: placing a lower layer of reinforcement; placing at least one sheet metal reinforcing part for shear reinforcement onto the lower layer of reinforcement in such a way that it is mainly at right angles to it and encompasses a reinforcing element of the reinforced-concrete column; placing an upper layer of reinforcement onto this at least one sheet metal reinforcing part in such a way that the latter serves as a spacer between the lower and the upper layer of reinforcement; and pouring concrete over the portion formed of the lower layer of reinforcement, the at least one sheet metal reinforcing part and the upper layer of reinforcement.

BRIEF DESCRIPTION OF THE DRAWINGS

Further details and advantageous developments of the invention result from the embodiment described in the following and shown in the drawing and from the subordinate claims FIG. 1 A vertical section of an embodiment of an arrangement in accordance with the invention, looked at along line I-I in FIG. 2.

DETAILED DESCRIPTION OF THE PREFERRED EMBODIMENT

Figure 1:
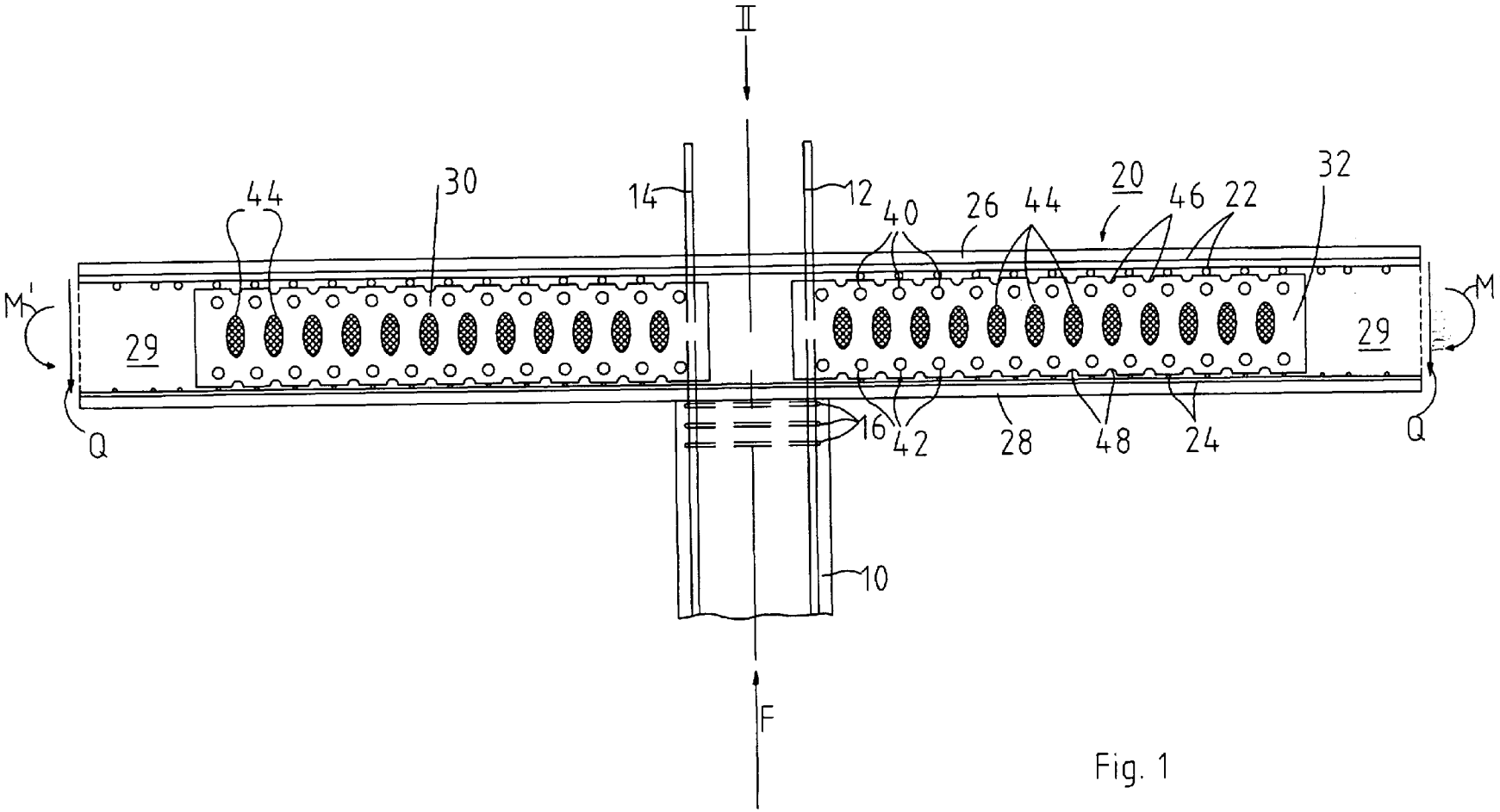

FIG. 1 shows a detail of a building with a vertical element (column or wall) 10 of reinforced concrete. In this vertical element 10 are reinforcing elements 12, 14 in the form of reinforcing bars. The bearing surface of column 10 is secured by means of steel stirrups 16.

Connected to the vertical element 10 is a reinforced concrete slab 20. (Alternatively this might be a beam system 20.) Floor 20 has an upper reinforcement 22 and a lower reinforcement 24 with a concrete covering 26 and 28, respectively, over each. Only part of floor 20 is shown.

Between the reinforcements 22 and 24 and preferably as spacers for these are sheet metal reinforcing parts which in FIG. 1 are marked as 30 for the left part of the floor 20 and with 32 for the right part of the slab. In the preferred embodiment such a reinforcing part 30, 32 is V-shaped in horizontal projection, see FIG. 2 where two additional reinforcements 34 and 36 are shown. Alternatively the shape could be that of a U or a hairpin.

Figure 3:
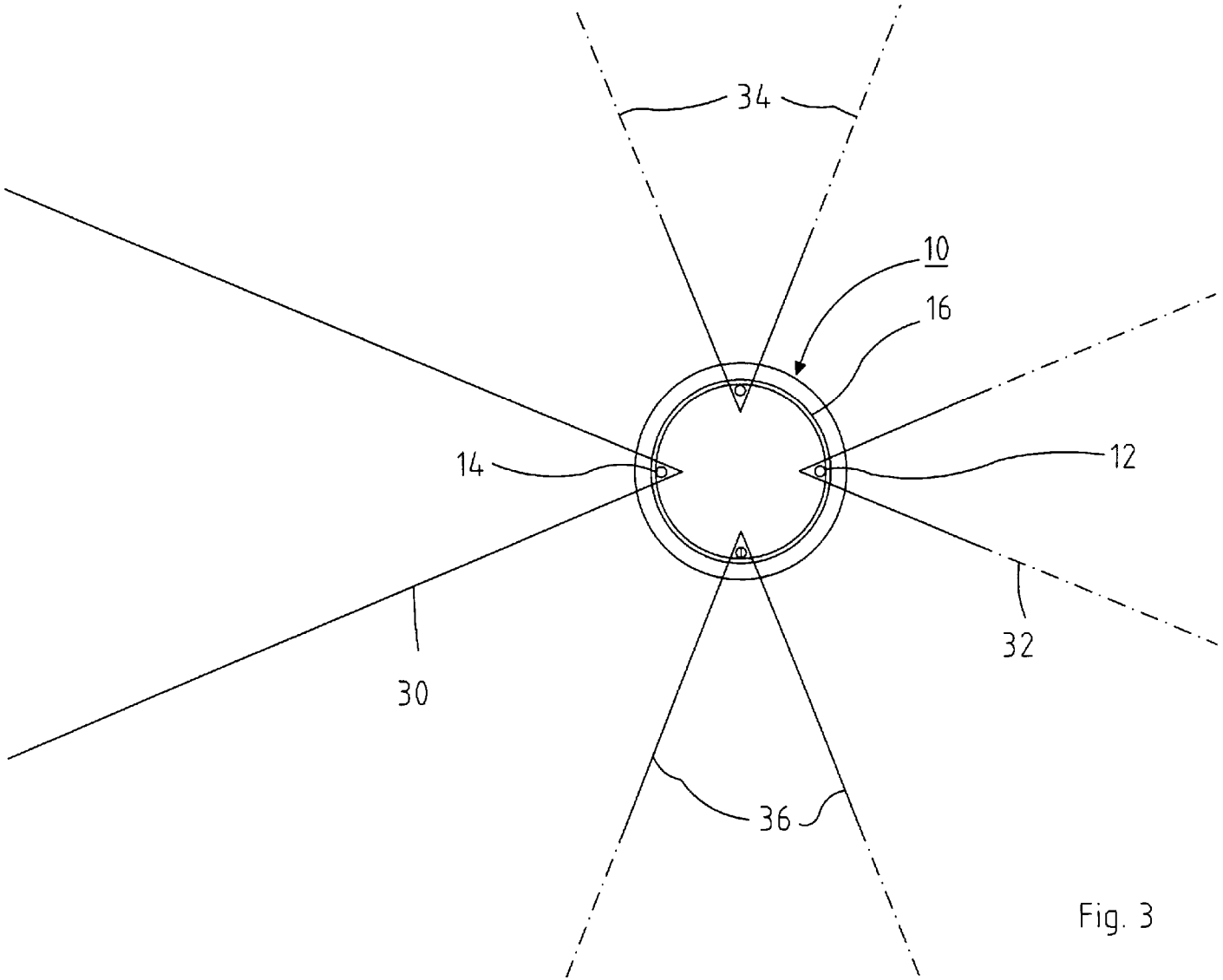
FIG. 3 An enlarged representation of a detail of FIG. 2.

The points of the reinforcements 30 and 32 each project into the border area of the vertical element 10 and encompass a reinforcing element 12, 14, assigned to them, see FIG. 1 and FIG. 3. Thus each sheet metal reinforcing part 30, 32 is horizontally anchored in the vertical element 10, engaged in it and can transfer its vertical force component into the bearing area secured by the stirrups 16.

The reinforcing parts 30, 32, 34, 36, preferably are made of sheet steel, usually between 2 and 6 mm thick. The thickness depends on static requirements. If and when required, the reinforcing parts can also be made of carbon fibers, suitable plastics or a composite material.

The reinforcing parts 30, 32, 34, 36, are thin and flat. For example, reinforcing part 32 stands on the lower reinforcement 24 which is located within the concrete floor 20. The upper reinforcement 22 lies on reinforcing part 32 and is located in the upper concrete covering 26. Reinforcing part 32 has recesses (holes) 40 in its upper border. It also has recesses 42 at its lower border area with diameters usually greater than 32 mm. The recesses 40, 42, which could also be called openings, are preferably circular and in this embodiment are arranged vertically one above the other. When the concrete 29 is placed, concrete 29 extends through each of these recesses 40, 42, forming "concrete dowels", i.e. anchorages, which transfer the shear forces from the concrete 29 into the respective sheet metal reinforcing part 30, 32, 34, or 36.

Figure 8:
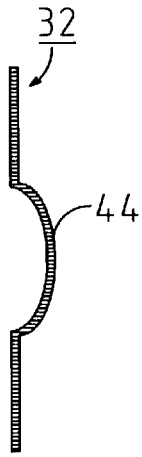
FIG. 8 A section, looked at along line VIII-VIII in FIG. 7.
Figure 9:
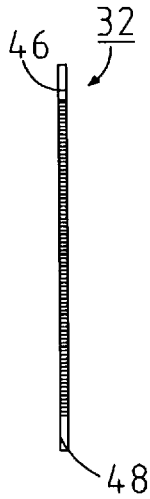
FIG. 9 A section, looked at along line IX-IX in FIG. 7.
Figure 10:
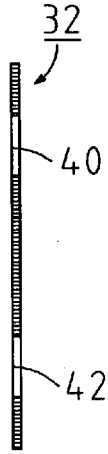
FIG. 10 A section, looked at along line X-X in FIG. 7.

Furthermore, the reinforcing elements 30, 32, 34, 36, are preferably provided with beads 44 (FIG. 8) in their middle section to improve anchoring in the concrete 29. Also, the reinforcing elements preferably have recesses 46 at the upper border and recesses 48 at the lower border. This makes these borders look toothed. The recesses 46 and 48 improve the transfer of forces into the respective reinforcing element.

FIG. 1 also shows a shearing force Q acting on the slab 20 from the left and right sides. A counterforce F acts against these forces Q from below. Furthermore, a clockwise moment M acting on the right side and a counterclockwise moment M' of the same amount acting on the left side, along with the forces mentioned, result in tensile and compressive stresses in the slab 20.

Figure 4:
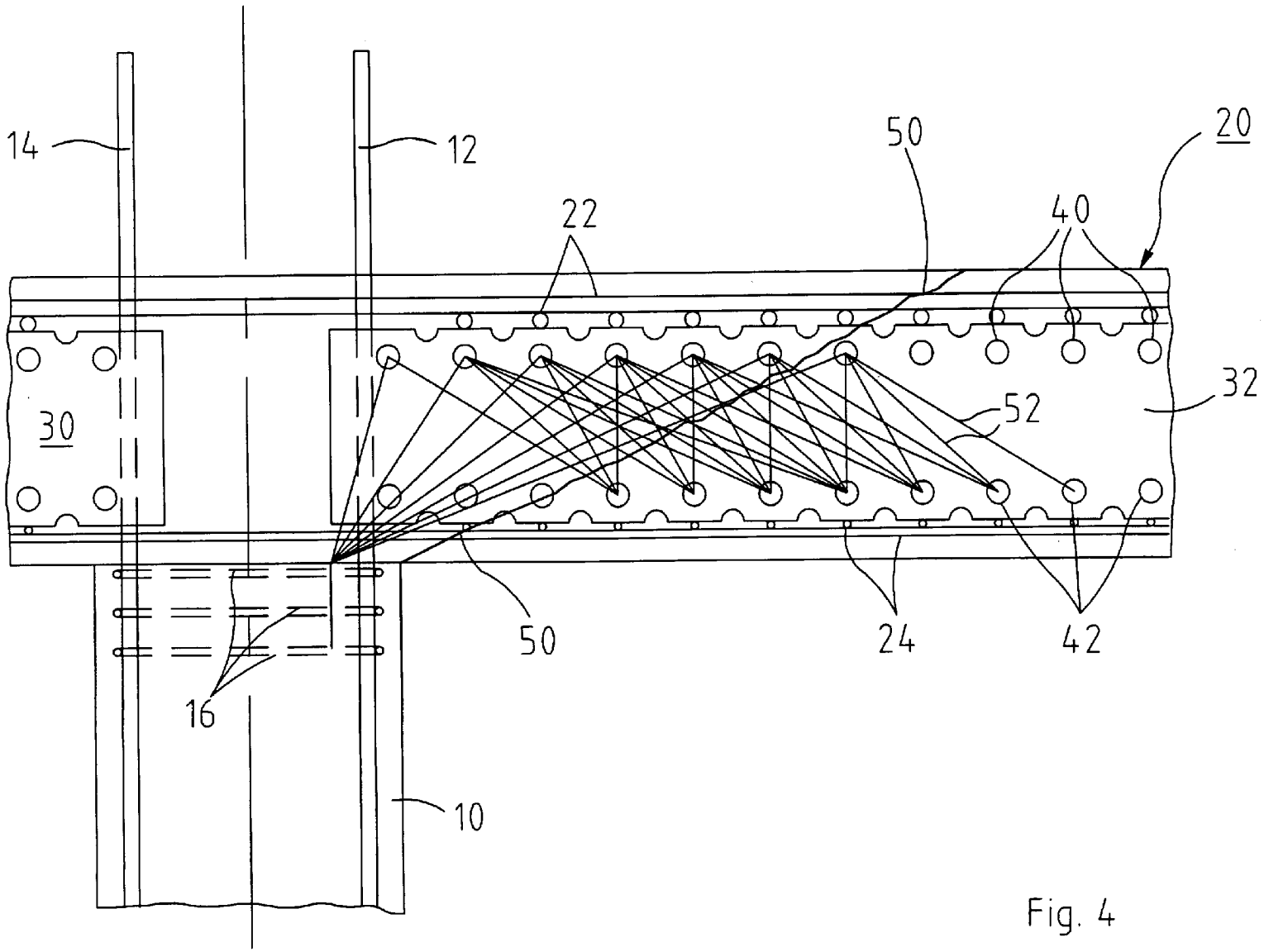
FIG. 4 A representation of the load paths in a sectional drawing analogous to FIG. 1.

FIG. 4 shows the load paths in a radial cut in the usual way of representation. The reference marks are the same as in FIG. 1 through 3. 50 identifies a zone in which one or more cracks occur in the concrete 29 under high load and where the floor 20 would usually break when the load becomes too high. In this case the surface of the fracture has roughly the shape of a funnel or cone, therefore the zone 50 is also called "punching shear cone". It can be seen that a large number of load paths 52 exist which are at angles and sometimes roughly perpendicular to this zone 50 and thus act against fracture in this place.

The struts starting at the column 10 are compressive struts. They are anchored in the inner area of the "punching shear cone" at the upper concrete dowels, i.e. the concrete dowels in the recesses 40. This is the load transfer into the sheet metal reinforcing part 32. From this anchorage, the struts, as shown, only run in the sheet metal reinforcing part 32 and a shear field is formed which effects a planar load path in the reinforcing part 32 up to the non-critical area outside the zone 50.

Figure 5:
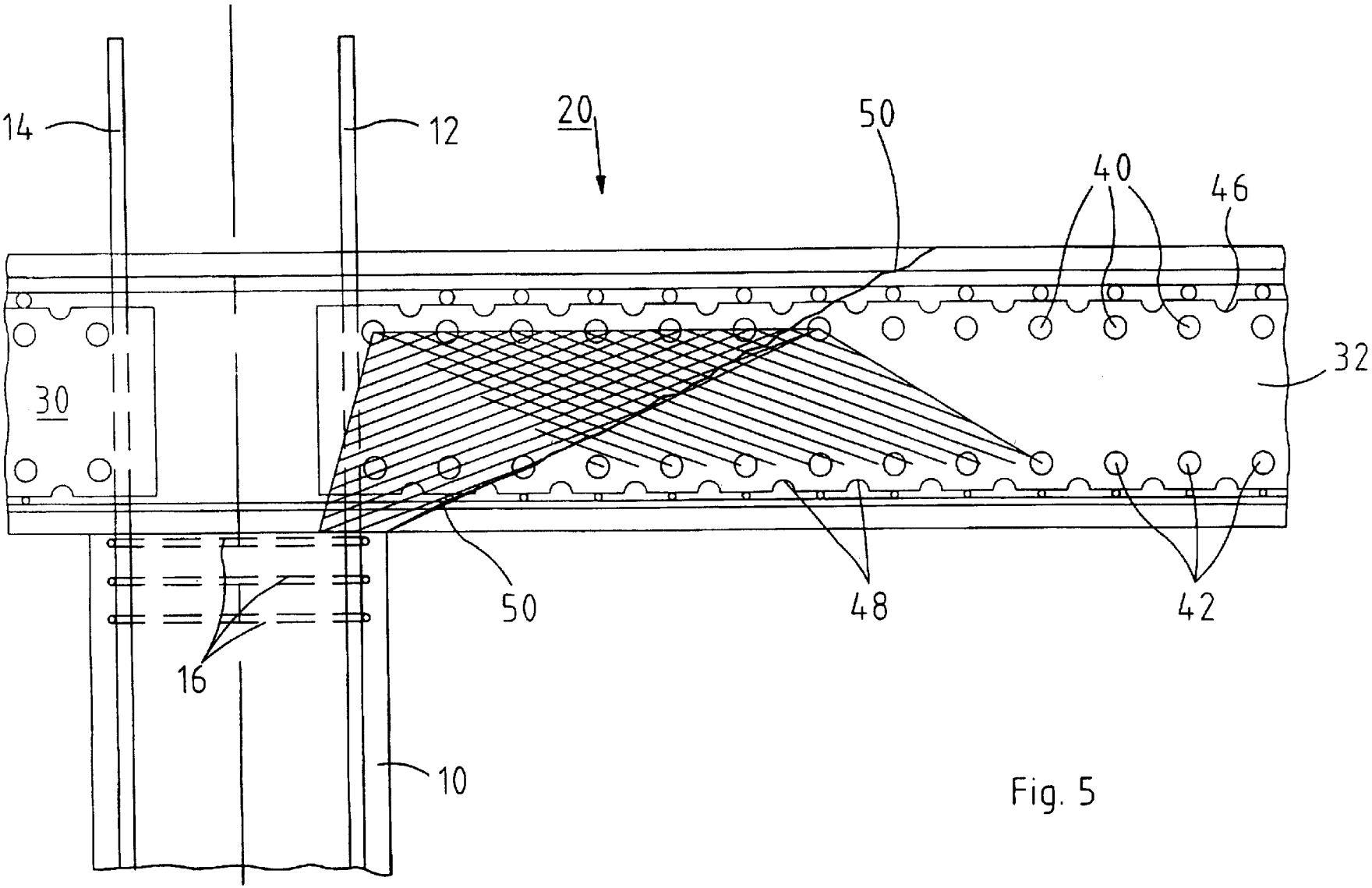
FIG. 5 A representation of the ties and struts, likewise in a sectional drawing analogous to FIG. 1.

FIG. 5, likewise in a usual way of representation, shows the ties and struts in a section. Here, too, it can be seen that the ties run at angles and roughly perpendicular to the zone 50, i.e. at angles and sometimes perpendicular to the "punching shear cone" and that therefore they act against fracture in this place because there are many possibilities of anchoring in the area of the "concrete dowels" mentioned (at recesses 40, 42). If first cracks appear in the concrete 29 when the ultimate tensile strength is reached, the load is distributed to the "concrete dowels" over the entire sheet metal reinforcing part 32 in a fan-like way, as shown in FIGS. 4 and 5. Participation of the concrete 29 for the ties is not necessary. The loads are carried off directly via the sheet metal reinforcing element 30,32, in accordance with the principle of minimum deformation work. As a consequence, the cracks 50 due to shear forces remain small and the ultimate strength of the slab 20 is maximized.

When the ultimate tensile strength of the concrete 29 in the tensile truss bars is reached, the sheet metal reinforcing part 32 assumes the function of the concrete.

If a rigid body mechanism is assumed in the ultimate load state, i.e. the remaining slab 20 is separated from the punching shear cone 50, then the shear forces are exclusively transferred via the sheet metal reinforcing part 32. Flexural and shear reinforcements are not decoupled.

When the ultimate limit state is reached, there should be early warnings that the arrangement shown is about to fail. The ductility of the sheet metal reinforcing part 30 and 32 is important for this, because in the case of such an arrangement, the shearing forces are transferred via the sheet metal reinforcing part 30, 32. So, when the ultimate limit state is reached, the sheet metal reinforcing parts 30 and 32 will fail, which are preferably made of steel, and such failure is a ductile steel failure and not a non-ductile concrete failure in the form of a shear-compressive fracture, i.e. there are warning signs and the failure will not be sudden. This is also important with regard to earthquakes.

The behavior of the "concrete dowels" in the recesses 40, 42, is sufficiently elastic and if one of them fails, the adjoining dowels will take up the load, i.e. the load is just relocated. The recesses 40, 42, and the beads 44 support the concrete dowels in the anchoring of the inclined compressive struts.

Reinforcement bars can be placed through the recesses 40, 42, and they can also be attached at these recesses by means of tie wire. This would be a further improvement.

Figure 2:
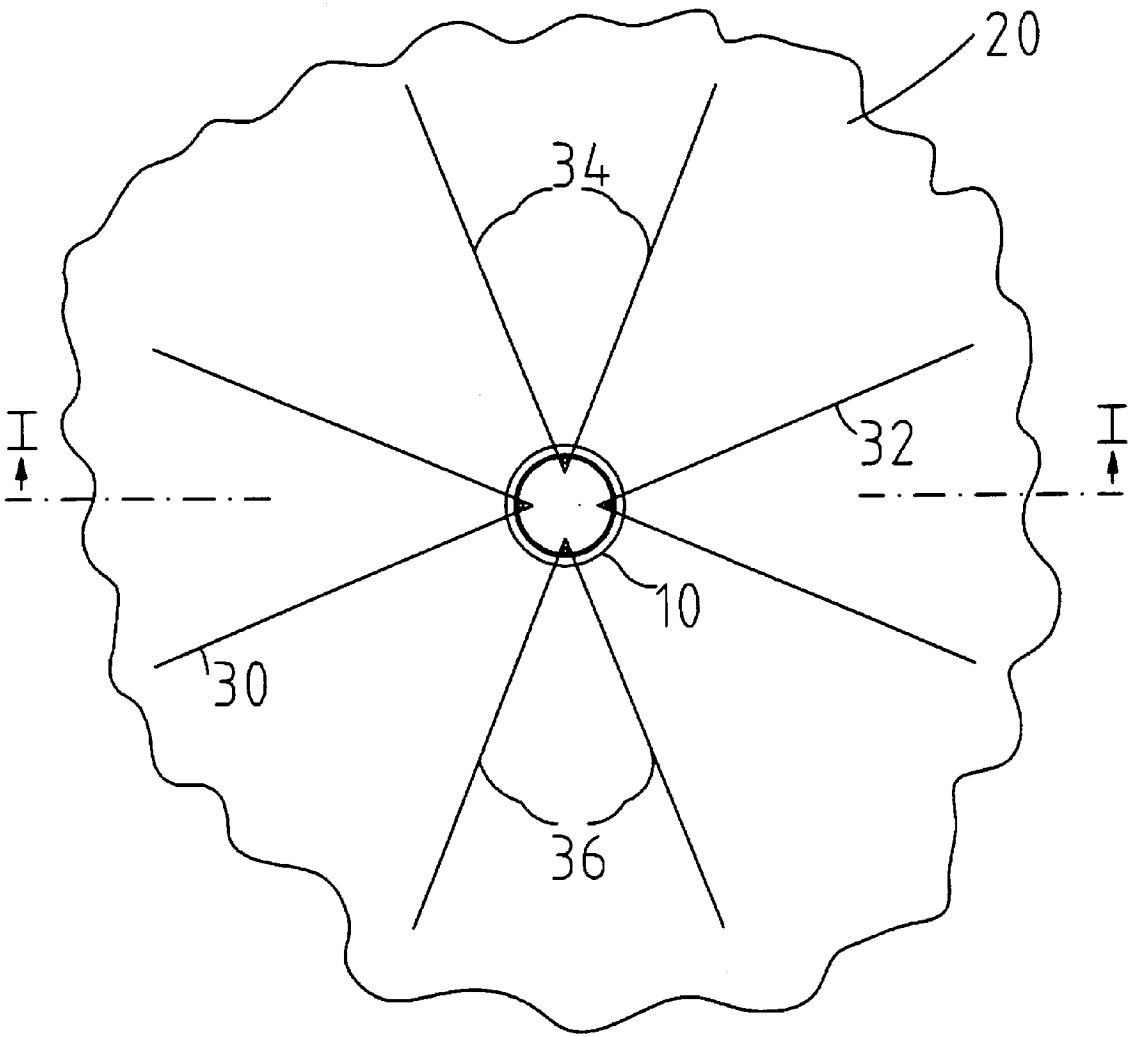
FIG. 2 A horizontal projection, looked at in the direction of arrow II in FIG. 1.
Figure 6:
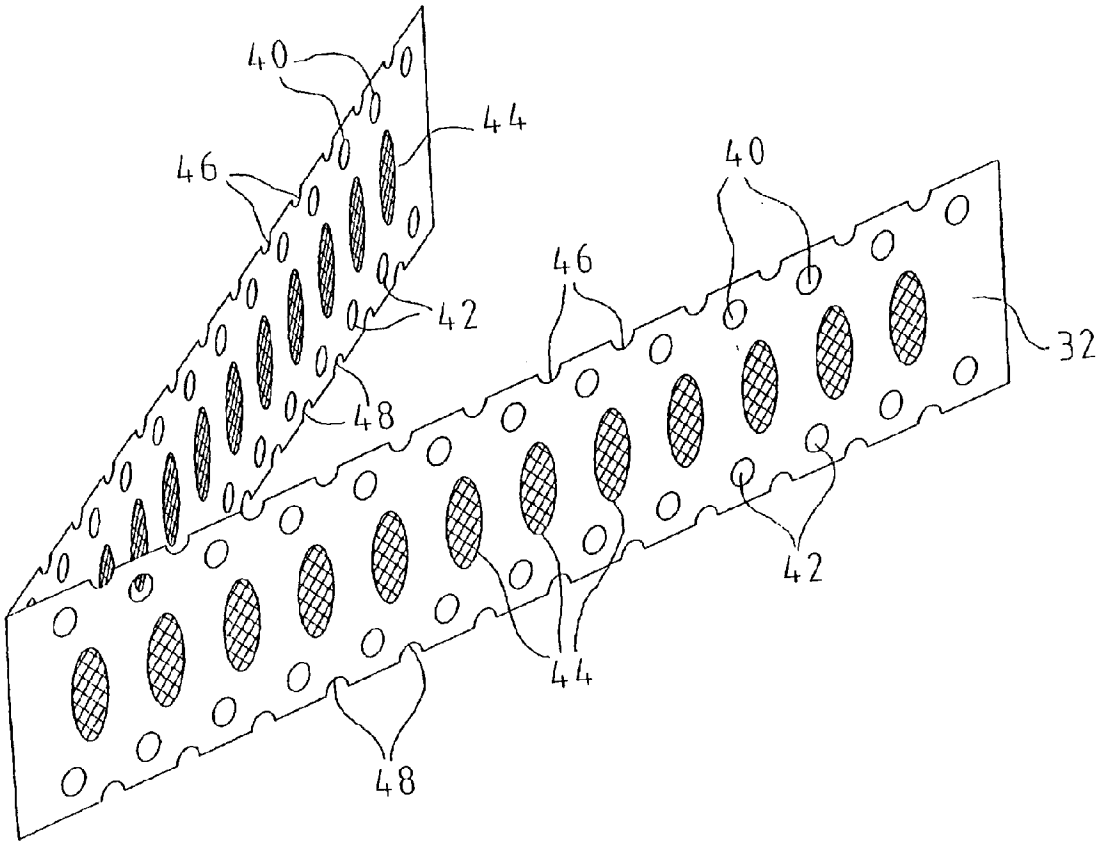
FIG. 6 An isometric drawing of a reinforcing part used in FIG. 1 through 3.
Figure 7:
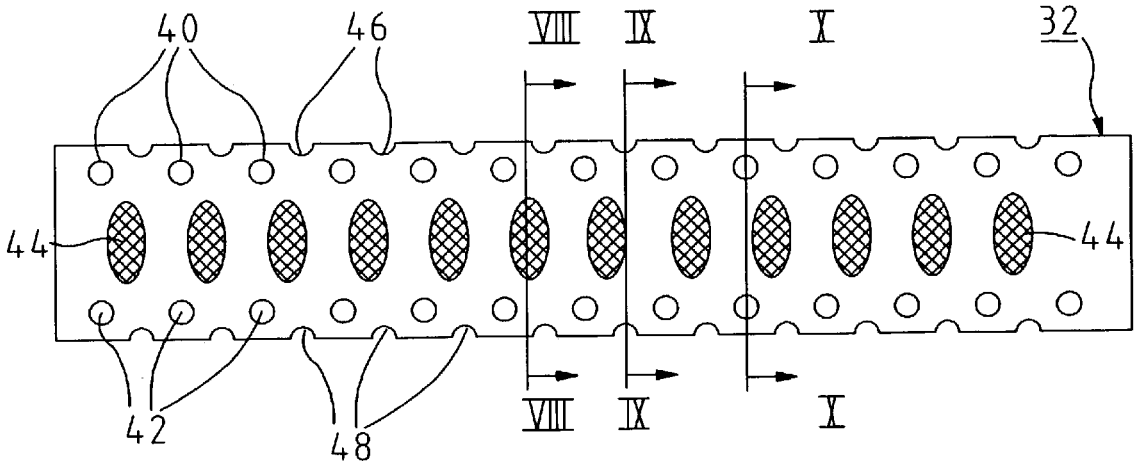
FIG. 7 A side view of a reinforcing part.

FIG. 6 shows an isometric drawing of the reinforcing part 32 of FIG. 1 through 3. The same reference marks are used.

FIG. 7, 8, 9 and 10 show details of the embodiment in accordance with FIG. 1 through 3 in different cutting planes.

Naturally, the invention presented allows a large number of variations and modifications.

While the foregoing is directed to embodiments of the present invention, other and further embodiments of the invention may be devised without departing from the basic scope thereof, and the scope thereof is determined by the claims that follow.

What is claimed is:

1. A slab reinforcement, comprising:

a concrete column comprising reinforcing elements extending through a slab portion;

the slab portion configured to transfer loads into the column and comprising:

at least one of concrete and prestressed concrete, an upper layer of reinforcement, and a lower layer of reinforcement; and at least one sheet metal reinforcing part:

essentially extending over a distance between the upper and lower layers of reinforcement, being substantially perpendicular to a surface of the slab portion, and comprising one or more anchors anchoring the sheet metal part to the concrete.

2. The slab reinforcement of claim 1, wherein the slab portion has a zone more susceptible to fracture than the rest of the slab portion and the sheet metal part extends through the fracture zone.

3. The slab reinforcement of claim 1, wherein the slab portion has a zone more susceptible to fracture than the rest of the slab portion and one of the anchors is disposed at one end of the fracture zone and a second anchor is disposed at a second end of the fracture zone.

4. The slab reinforcement of claim 2, wherein the slab portion has a zone more susceptible to fracture than the rest of the slab portion and one of the anchors is disposed at one end of the fracture zone and a second anchor is disposed at a second end of the fracture zone.

5. The slab reinforcement of claim 1, wherein the one or more anchors comprise a plurality of holes sized to allow the formation of concrete dowels therethrough.

6. The slab reinforcement of claim 2, wherein the one or more anchors comprise a multitude of holes sized to allow the formation of concrete dowels therethrough.

7. The slab reinforcement of claim 3, wherein the one or more anchors comprise a multitude of holes sized to allow the formation of concrete dowels therethrough.

8. The slab reinforcement of claim 1, wherein the sheet metal part further comprises at least one of beads and recesses, the recesses disposed in at least one border of the sheet metal part.

9. The slab reinforcement of claim 2, wherein the sheet metal part further comprises at least one of beads and recesses, the recesses disposed in at least one border of the sheet metal part.

10. The slab reinforcement of claim 3, wherein the sheet metal part further comprises at least one of beads and recesses, the recesses disposed in at least one border of the sheet metal part.

11. The slab reinforcement of claim 5, wherein the sheet metal part further comprises at least one of beads and recesses, the recesses disposed in at least one border of the sheet metal part.

12. The slab reinforcement of claim 1, wherein the sheet metal reinforcing part comprises a vertex and one of the reinforcing elements is arranged inside the vertex encompassing at least one of the reinforcing elements.

13. The slab reinforcement of claim 3, wherein the sheet metal reinforcing part comprises a vertex and one of the reinforcing elements is arranged inside the vertex encompassing at least one of the reinforcing elements.

14. The slab reinforcement of claim 5, wherein the sheet metal reinforcing part comprises a vertex and one of the reinforcing elements is arranged inside the vertex encompassing at least one of the reinforcing elements.

15. The slab reinforcement of claim 8, wherein the sheet metal reinforcing part comprises a vertex and one of the reinforcing elements is arranged inside the vertex encompassing at least one of the reinforcing elements.

16. The slab reinforcement of claim 1, wherein the one or more anchors comprise a plurality of holes and a plurality of reinforcement bars disposed through the holes.

17. The slab reinforcement of claim 16, wherein the reinforcement bars are attached to the holes.

18. The slab reinforcement of claim 1, wherein the sheet metal part is designed as a spacer between the upper layer of reinforcement and the lower layer of reinforcement.

19. The slab reinforcement of claim 2, wherein the sheet metal part is designed as a spacer between the upper layer of reinforcement and the lower layer of reinforcement.

20. A method of manufacturing a reinforced ceiling onto a concrete column, the column comprising reinforcing elements, the method comprising:

a) placing a lower layer of reinforcement onto the column;

b) placing at least one sheet metal reinforcing part for shear reinforcement onto the lower layer of reinforcement;

c) placing an upper layer of reinforcement onto the sheet metal part in such a way that the sheet metal part serves as a spacer between the lower and the upper layers of reinforcement; and d) pouring concrete over the portion formed of the lower layer of reinforcement, the sheet metal part and the upper layer of reinforcement.

21. The method of claim 20, wherein the ceiling has a zone more susceptible to fracture than the rest of the ceiling and placing the sheet metal part further comprises placing the sheet metal part in such a way that the sheet metal part extends through the fracture zone.

22. The method of claim 20, wherein placing the sheet metal part further comprises placing the sheet metal part so that the sheet metal part surrounds a portion of one of the reinforcing elements.

23. The method of claim 20, wherein placing the sheet metal part further comprises placing the sheet metal part so that the sheet metal part is substantially perpendicular to the lower layer.

24. The slab reinforcement of claim 1, wherein the sheet metal part extends into the column.

25. The slab reinforcement of claim 1, wherein the sheet metal part surrounds a portion of one of the reinforcement elements.

* * * * *